US005343936A

United States Patent [19]

Beatenbough et al.

[11] Patent Number: 5,343,936

[45] Date of Patent: * Sep. 6, 1994

[54] SPIRAL RIPPLE CIRCUMFERENTIAL FLOW HEAT EXCHANGER

[75] Inventors: Paul K. Beatenbough, Medina; Kris J. Meekins, Bemus Point; Clark E. Stohl, Lakewood, all of N.Y.

[73] Assignee: Long Manufacturing Ltd., Oakville, Canada

[ * ] Notice: The portion of the term of this patent subsequent to Apr. 20, 2010 has been disclaimed.

[21] Appl. No.: 980,871

[22] Filed: Nov. 24, 1992

Related U.S. Application Data

[63] Continuation-in-part of Ser. No. 437,680, Nov. 17, 1989, Pat. No. 5,203,832.

[51] Int. Cl.[5] ..... F28F 3/04; F28F 3/12; F28F 3/08

[52] U.S. Cl. ..... 165/41; 165/51; 165/167; 165/916

[58] Field of Search ..... 165/41, 167, 81, 916, 165/166

[56] References Cited

U.S. PATENT DOCUMENTS 5,179,999 1/1993 Meekins et al. ..... 165/41
5,203,832 4/1993 Beatenbough et al. ..... 165/41

FOREIGN PATENT DOCUMENTS 351020 12/1932 United Kingdom ..... 165/167
424580 2/1935 United Kingdom ..... 165/167

*Primary Examiner*—John K. Ford
*Attorney, Agent, or Firm*—Barrigar & Moss

[57] ABSTRACT

The invention relates to an improved energy exchange structure, comprising generally parallel plates,connected to define a hollow passageway for the generally circumferential flow of fluid between an inlet and an outlet, said plates undulating in cross-section to define obliquely disposed crossing opposing valleys arranged in a spiral disposition.

13 Claims, 4 Drawing Sheets

SPIRAL RIPPLE CIRCUMFERENTIAL FLOW HEAT EXCHANGER

This invention relates to an improved ripple plate heat exchanger, having particular application in automotive engine oil cooling utilities where high ratios of heat transfer to oil pressure drop are desired. This application is a continuation-in-part of U.S. application Ser. No. 07/437,680 filed Nov. 17, 1989.

BACKGROUND OF THE INVENTION

With the development of lighter, high revolution, high torque and more compact internal combustion engines, there has been increased need for more efficient oil cooling means. Many auto engine manufacturers have incorporated into their basic engine design the need for oil cooling means in addition to that which can be attained through traditional cooling fluid passages integrally molded into the engine block. Some manufacturers have specified the use of non-integral oil coolers which act to cool a flow of oil by means exterior to the engine block. One typical mounting means comprises mounting the oil cooling means at an oil filtering means. To satisfy the demands of the automotive industry, such cooling means must typically be compact, lightweight and capable of high heat transfer efficiency while not adversely reducing oil pressures. Thus, the continuing need to provide lighter and more efficient heat transfer devices, has occasioned the development of a multiplicity of new designs and configurations in the manufacture of heat transfer devices for use in automotive oil cooling systems.

Early externally mounted heat transfer devices generally used as oil, coolers in automotive applications typically comprised a continuous serpentine configured tube, with and without fins, mounted exterior to the engine typically in the air system in front of the radiator or within the cooling system radiator. Oil, such as transmission or engine oil and the like, is routed to flow through the tube to be cooled. A cooling medium typically was passed over the tube, for example within a coolant containing radiator or an air cooling separate unit, thus allowing energy exchange from the heated oil in the tube to the cooling medium.

With the need for compact efficiencies oil coolers were later introduced which were mounted on the engine, typically between the engine block and an externally mounted oil filter assembly, that cooled the oil going to or coming from the filter by utilizing fluid flow from the engine cooling system. These filter mounted coolers generally use multiple hollow, generally parallel spaced plate structures between which oil and cooling fluid flows in parallel planes to maximize heat transfer. Such spaced plate structures may contain fins between the hollow plate structures or are of ripple plate configuration. In such devices oil flows to the cooler from a port located at or about the filter mount and circulates between parallel plates of the cooler. Coolant from the engine cooling system circulates between and/or about the parallel plates confining the circulating oil and acts to transfer heat energy from the oil to the coolant. Many variations of the system exist, with oil being filtered first then flowing to the cooling device or the reverse and typically with coolant flowing from the cooling system of the engine, usually from the radiator or the water pump, to the cooling device.

One typical characteristic of filter mounted oil coolers is that one or both of the two fluids flow in a generally circular direction about the center of the cooler and typically the heat transfer elements, that is the fins or ripples, are typically not aligned in more than one or two directions. We have found that such configuration of the fins or ripples results in areas of decreased heat transfer efficiency to pressure drop within the heat exchanger.

A problem thus continues to exist particularly in optimizing heat transfer ratios to oil pressure drop within the heat exchanger. With the increased average operating revolutions of modern engines, coupled with the high torque and decreased response times, the need for oil cooling devices which are highly efficient and have minimum effect upon the oil pressure of the engine oiling system, have become desirable.

U.S. Pat. application Ser. No. 07/437,680 now U.S. Pat. No. 5,203,832, of which this invention is a continuation-in-part, provides for an improved energy exchange structure, wherein joined, generally parallel opposing plates are undulated in cross-section to define a plurality of opposing valleys which generally follow involute curves. The opposing valleys extend into a hollow passageway between the plates and are obliquely disposed to a circular direction of fluid flow within the passageway. Valleys of a first plate are arranged to cross valleys of a second plate such that the area between opposing valleys define crossing passages through which the fluid can flow.

One object of this invention is to provide energy exchange structures having improved heat transfer.

A further object of the invention is to provide energy exchange structures having reduced internal fluid pressure drop.

Another object of the invention is to provide an automotive oil cooler having reduced internal oil pressure drop.

A still another object of the invention is to provide a method of manufacturing an energy exchange structure having efficient heat transfer and reduced internal fluid pressure drop.

These and other objects of the invention are achieved by the invention described as follows.

SUMMARY OF THE INVENTION:

The invention relates to an improved energy exchange structure, comprising first and second generally parallel opposing plates, connected to define a hollow passageway for the generally overall circular flow of fluid from an inlet to an outlet, each of said opposing plates undulating in cross-section to define a plurality of opposing valleys extending into the hollow passageway, the valleys being arranged to follow generally spiral curves that are obliquely angled to a circular flow direction within the hollow passageway defined by the joined plates.

Opposite ends of the valleys extend generally in the direction of the inlet and the outlet and the valleys extend less than one circumscription of the plate. By the latter is meant that a valley does not traverse the plate circumlinearly more than once. Apexes of valleys of the first plate are arranged to cross apexes of opposing valleys of the second plate such that the area between opposing valleys of the opposing plates defines crossing passages through which the fluid can flow. Generally, the valleys are arranged such that adjacent valleys are not parallel.

The improved automotive oil coolers of the invention comprise multiple opposing plates, stacked to form a plurality of interconnected energy exchange structures through which oil can flow for dissipation of heat. Inlets of the energy exchange structures terminate at an inlet header where they are parallel interconnected with other inlets of energy exchange structures, and/or serially interconnected with outlets of other energy exchange structures. Outlets terminate at an outlet header and also are parallel and/or serially interconnected with outlets or inlets of other energy exchange structures. The flow of fluid through the energy exchange structure is typically a circular flow from an inlet positioned at a point adjacent an outlet, around a barrier positioned generally centrally in the exchange structure, to the outlet. Typically there is a further barrier between the outlet and the adjacent inlet which resists direct fluid flow between the adjacent inlet and outlet and encourages generally circular flow around the central barrier. The central barrier typically comprises a ring through which the plates are connected. The interconnected, stacked energy exchange structures provide passage for the flow of oil within the energy exchange structures and passage for the flow of cooling fluid exterior to the energy exchange structures. A preferred cooling fluid flow is generally at an oblique angular direction to the opposing valleys of the opposing plates of the energy exchange structures to enhance energy exchange.

The energy exchange structures may be confined within a tank like container wherein a liquid and/or gaseous coolant can be circulated over and between the opposing plates comprising the energy exchange structures, or may be exposed to allow the flow of air or the like thereover. The periphery of the stacked energy exchange structures may be joined to the tank walls to define separated coolant passages which also may be separately connected, parallel interconnected or serially interconnected to coolant inlets and/or outlets.

The improved automotive oil coolers of the invention are produced by a process wherein opposing plates, undulating in cross-section to have a plurality of valleys arranged to follow spiral curves obliquely disposed to the direction of flow of a fluid between said plates, are arranged such that apexes of valleys of a first plate cross apexes of opposing valleys of a second plate and the area between opposing valleys define crossing passages which are obliquely disposed preferably at from about 5 to about 75 degrees to the circumferential direction of the energy exchange structure. Said first and second plates are joined to form a hollow passageway, comprising a fluid inlet and a fluid outlet, the passageway being arranged to direct fluid entering the passageway from an inlet in a generally circular flow around a central barrier to an outlet. The multiple energy exchange structures can be assembled in series and/or parallel to form the cooler, with an inlet of a first energy exchange structure connected to an inlet or to an outlet from a second energy exchange structure. Typically, it is preferred to assemble two or more groups of parallel connected energy exchange structures with each group in serial arrangement with inlet and outlet headers.

Typically the so assembled energy exchange structures are encased in a tank like container having a cooling fluid inlet and outlet means. Generally, the external joined borders of the opposing plates are extended in a joined flattened plate, typically with crimped exterior border, to provide additional energy exchange surface at the exterior borders of the structure. Such extension allows the circulation of coolant around the exterior boundaries of the stacked structures for cooling and provides convenient means for interconnecting the exchange structures to stabilize them within the encasing tank.

Figure 1:
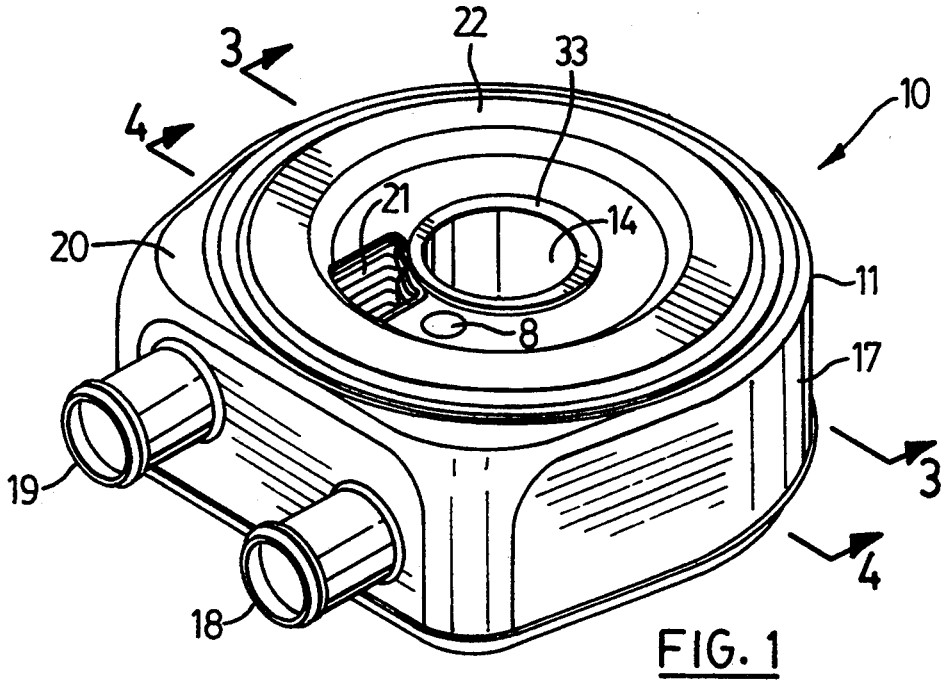
FIG. 1 is a top perspective view of an oil cooler made in accordance with the present invention.
Figure 2:
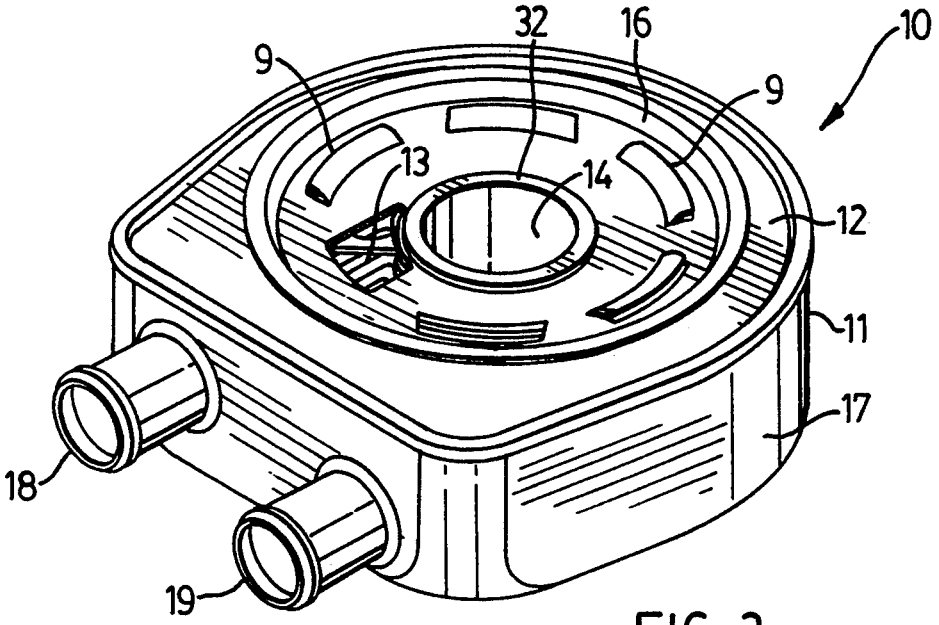
FIG. 2 is a bottom perspective view of the oil cooler of FIG. 1.

DETAILED DESCRIPTION OF THE INVENTION:

An exemplary embodiment of an automotive oil cooler made according to the invention is illustrated in FIGS. 1 and 2. It should however be understood that the present invention can be utilized in a plurality of other applications wherein an energy exchange structure is desired.

Figure 3:
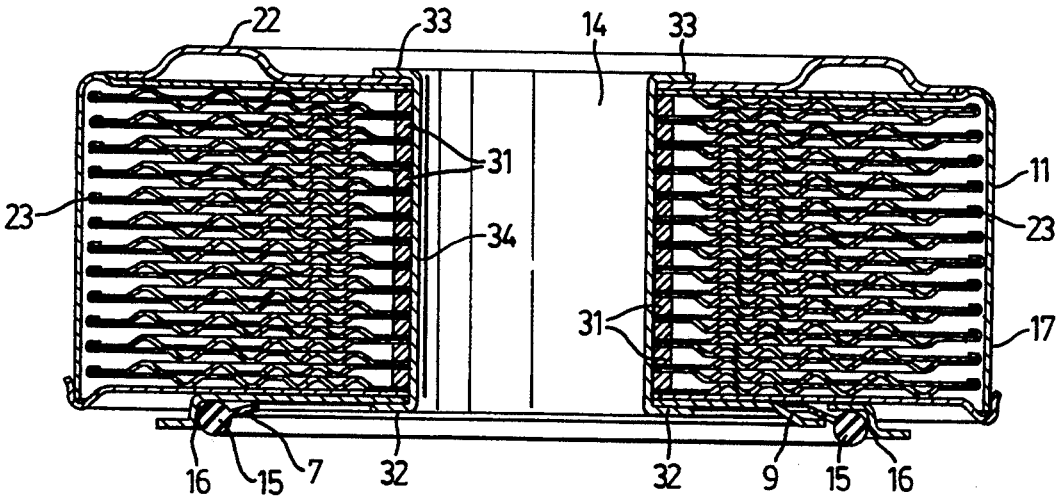
FIG. 3 is a sectional view taken approximately on lines 3—3 of FIG. 1.
Figure 4:
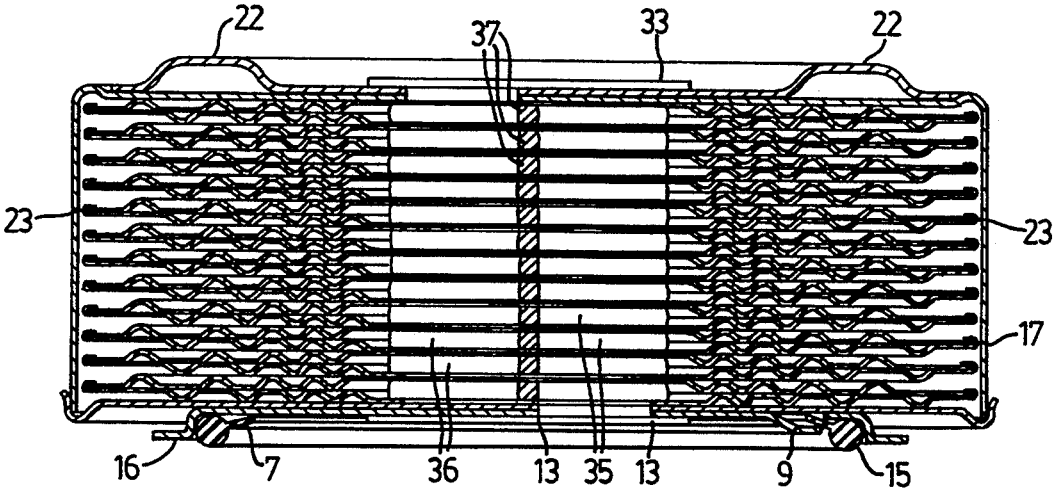
FIG. 4 is a sectional view taken approximately on lines 4—4 of FIG. 1.

Referring now to FIGS. 1 and 2, therein a typical automotive oil cooler 10 is illustrated which is generally installed between the automotive engine and the oil filter in a typical automotive application. Cooler 10 comprises canister 11, with motor attachment end 12, oil filter attachment end 20, exterior canister side 17 and interior canister opening or hole 14. Motor attachment end 12 comprises oil inlet 13, oil seal retaining flange 16 and oil seal retaining lips 9 that fittingly retain oil seal 15 through engagement of oil seal tab 7, as illustrated in FIGS. 3 and 4. The filter attachment end 20 comprises pressure release port 8. Typically a release port comprises a pressure actuatable cover mechanism that will open the port and permit oil to flow from the oil inlet header of the cooler directly to the filter without passage through the exchange structures. Such actuatable mechanism is typically arranged such that upon sensing a defined back pressure to the flow of oil through the exchange structures, typically occurring if the structures become clogged to the flow of oil, the port is opened to allow oil flow directly from the motor to the filter and back to the motor. Generally, a like arrangement is contained in the filter so that the flow of oil will continue through the motor regardless of whether each or both become clogged. Exterior canister side 17 of canister 11 comprises coolant inlet 18 and coolant outlet 19. Oil filter attachment end 20 comprises oil outlet 21 and oil filter seal surface 22. Interior canister hole 14 extends from motor attachment end 12 through to oil filter attachment end 20, and provides an opening through which a nipple can be placed so an oil filter can be removably attached to the motor in order to seal the oil cooler and the filter to the motor and provide passage back to the motor of cooled and filtered oil.

Oil cooler 10 comprises a plurality of hollow energy exchange structures 23, contained within canister 11, through which oil flows between oil inlet 13 and oil outlet 21. Surrounding at least a portion of the energy exchange structures are hollow passages through which coolant can flow in energy exchange relationship with the hollow energy exchange structures from coolant inlet 18 to coolant outlet 19.

In a typical operation of the illustrated embodiment, a first, heat energized, fluid such as hot engine oil enters oil cooler 10 through oil inlet 13, flows between opposing plates through the generally circular passages of a plurality of hollow energy exchange structures and through cooler motor oil outlet 21 to the inlet of an oil filter (not illustrated). The cooled oil flows through the oil filter, and is directed through a nipple or hollow oil filter attachment shaft (not illustrated) which extends through interior canister hole 14 to the motor. The hollow oil filter attachment shaft, engages the motor and is typically threaded to compressingly attach the oil cooler and filter assemblies to the motor. The shaft thus provides both a means of attachment of the filter and the cooler to the motor and a passageway for cooled and filtered oil flow back to the motor from the filter.

Alternately, it should be understood that the oil can flow in reverse direction from the motor through the attachment shaft, to the filter, through the cooler and back to the motor from the cooler.

The flow of oil through the exchange structures is directed by the angularly disposed, spiral curve arranged, valleys which extend inwardly to the hollow passageway of the opposing plates. The oil stream is passively separated and mixed by the crossing paths of valleys increasing oil stream contact with opposing plates of the energy exchange structure. Heat energy from the oil is dissipated to the opposing plates of the energy exchange structures and to any fin plates which may be in contact therewith.

A second fluid flow, typically a liquid coolant such as a water/antifreeze mixture, flows through coolant inlet 18 such that the coolant flows across the opposing plates and any fin plates that may be in contact therewith, preferably counter current to the oil flow. Heat energy dissipates from the energy exchange structures to the coolant when the heat energy of the coolant is less than that of the energy exchange structures. he coolant flows through the canister containing the energy exchange structures through coolant outlet 19 for recycle through the cooling system.

Figure 3A:
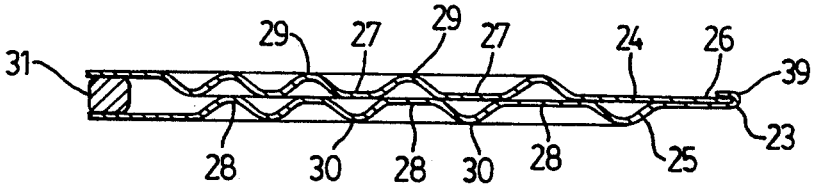
FIG. 3A is an enlarged sectional view of a hollow energy exchange structure 23 of FIG. 3.

Referring now to FIG. 3, therein is illustrated a sectional view of the oil cooler of FIG. 1 taken approximately on lines 3—3, which illustrates a stacked arrangement of hollow energy exchange structures 23, within canister 11. In FIG. 3A, an energy exchange structure 23 is enlarged and illustrated as comprising upper undulating plate 24 and lower opposing undulating plate 25, which is illustrated as being of greater diameter than the upper plate, and is joined to the upper plate by crimping thereover, then forming crimped edge 39 on exterior joined border 26. Apexes of inwardly extending valleys 27 of the upper opposing plate 24 cross opposing apexes of inwardly extending valleys 28 of lower opposing plate 25, with the area between apexes of valleys of a plate comprising crests 29 in upper plate 24 and crests 30 in lower plate 25. The inwardly extending valleys direct oil flow within the exchange structures along the crests, with crossing valleys continuously effecting a passive separation, mixing and oblique, spiral redirecting of the oil flow stream generally along a circumferential flow direction from energy exchange structure inlet to energy exchange structure outlet. The area between stacked energy exchange structures comprises passageways also resulting from the undulating plates. Coolant flowing through these passageways is directed along the spiral arrangement of valleys 27 and 28. As with the flow of oil, the spiral arrangement of the valleys continuously effects a passive separation, mixing and oblique spiral redirecting of the coolant stream from coolant inlet to coolant outlet.

In the illustrated embodiment of FIG. 3, the interior central borders of upper plates 24 and lower plates 25 are conveniently connected through compression rings-31 to provide structural integrity of the hollow exchange structures and fluid separation from the cooling passages therebetween. Interior canister hole surface 34, with upper lip 33 and lower lip 32 holds motor attachment end 12 and filter attachment end 20 in compressing engagement to join upper plates 24 and lower plates 25, in alternating direct and interspaced relationship with compression rings 31, to each other.

FIG. 4 comprises a sectional view of FIG. 1, particularly illustrating oil inlet header 35 and oil outlet header 36. Thereat, upper plates from a first stacked energy exchange structure are connected to lower plates of a second energy exchange structure, about the interior periphery of the headers, to provide sealed separation of the coolant flow from the oil flow of the exchange structures. It should be understood that though the embodiment illustrates common headers between all inlets and outlets of the energy exchange structure for a parallel oil flow between exchange structures, the invention specifically contemplates and includes separate headers between outlets and inlets of the stacked exchange structures for series oil flow.

The plates of the exchange structures are connected by any appropriate means that provide a seal of sufficient structural integrity to withstand the pressures generated within the system. Typically braze weld bonding is a preferred embodiment when the materials of construction are stainless steel, copper, brass or aluminum. In the event polymeric or ceramic materials are the materials of choice, preferable joining may comprise solvent or adhesive bonding, or heat or ultrasonic bonding. Mechanical crimping is a preferred method of connecting the outer periphery of the plates of a structure.

Figure 5:
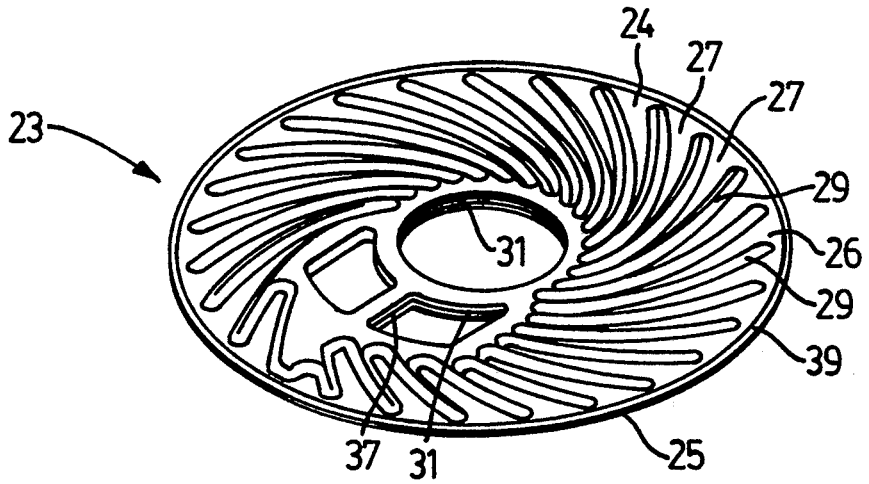
FIG. 5 is a perspective view of an energy exchange structure made in accordance with the present invention.

FIG. 5 illustrates a preferred embodiment of the energy exchange structures of the invention. Therein, energy exchange structure 23 comprises opposing undulating upper plate 24 and undulating lower plate 25. Upper plate 24 comprises inwardly extending valleys 27 and lower plate 25 comprises opposing inwardly extending valleys 28 (not shown). The area between valleys of upper plate 24 comprising crests 29 and the area between valleys of lower plate 25 comprising crests 30 (not shown) each of which comprise passages through which oil flows. The opposing plates are joined at their exterior border 26 and comprise crimped edge 39. In the preferred embodiment illustrated, the exterior border is brazed welded to insure structural integrity of the seal of the energy exchange structures. The interior central border and/or barrier of the exchange structure comprises compression ring 31 through which the plates are connected. Typically the compression rings also comprise a leg 37, perpendicular to the circular surface of the ring that extends between an adjacent outlet and inlet to provide a barrier to prevent direct fluid flow therebetween, or the plates are joined therebetween.

The valleys of the opposing plates can be conveniently formed by stamping, embossing, or otherwise forming the desired shaped valleys into the plates. The valleys can be shaped along spiral curves or can be otherwise curved or generally straight shaped and be arranged generally along a spiral curve. When the valleys are shaped along spiral curves they may typically be of any length within the confines of the curve on the plate. When the valleys are not shaped along spiral curves but generally arranged along spiral curves, they are typically straight or slightly curved and it is preferred they comprise shortened segments to reduce the extent of valley generally varying from the spiral curvature.

Valleys arranged in spiral curves are generally not equidistant spaced from adjacent valleys throughout their length. By being not equidistant spaced is meant that the distance between adjacent valleys generally changes during the valley's length.

The area between adjacent valleys comprise adjacent crests. Neither adjacent crests nor adjacent valleys need be of the same width. The crests can be in the same plane as the plate, or can be stamped, embossed, or otherwise formed to extend above the plane of the plate. It should be understood that other means well known in the art are contemplated for use in the formation of the valleys and crests, including molding and the like.

Generally the crests and valleys will be at an oblique angle to a circumferential fluid direction around a central barrier from the inlet to the outlet of the plate. Preferably, the oblique angle will be from about 5 to about 75 degrees from a circumferential direction of oil flow between the inlet and outlet of the plate and most preferably from about 15 to about 45 degrees.

Opposing first and second plates, having angularly disposed valleys, are assembled so that the valleys of the first plate cross opposing valleys of the second plate. It is not essential for the valleys or crests of the first plate to be at the same oblique angle to the longitudinal direction as those of the second plate, through such is generally preferred.

Figure 6:
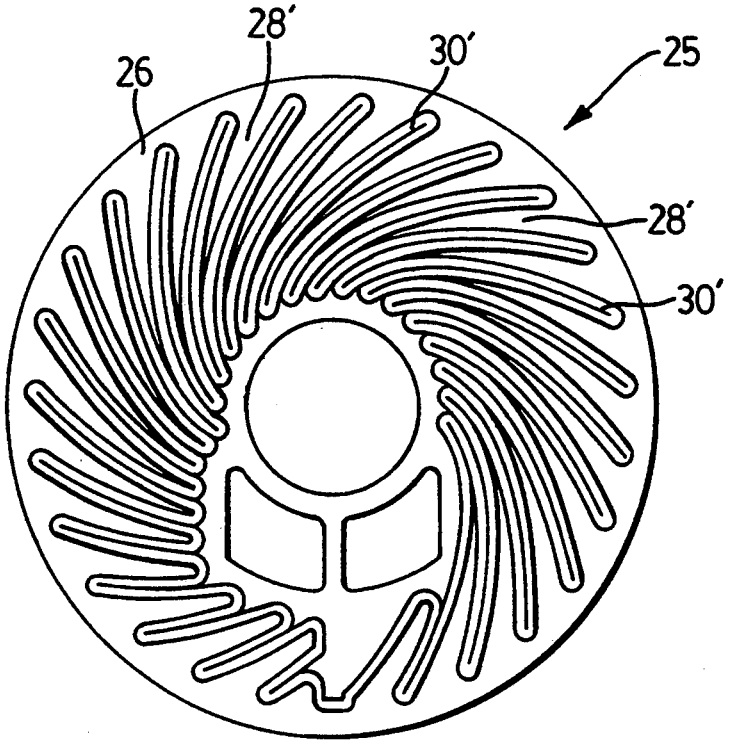
FIG. 6 is a plan view of the interior surface of the lower plate of FIG. 5.

FIG. 6 is a plan view of the interior facing surface of the lower plate 25. Valleys 30' correspond to crests 30 in FIG. 3A and are arranged to follow spiral curves, changing in distance to adjacent valleys throughout their length on a plate. Crests 28' corresponding to valleys 28 in FIG. 3A are illustrated as being between the valleys 30' and the valleys are illustrated, in this embodiment, as being of essentially equal width. It should be understood that the invention contemplates and includes configurations wherein crests or valleys of a plate are not equal in width to adjacent crests or valleys.

Figure 7:
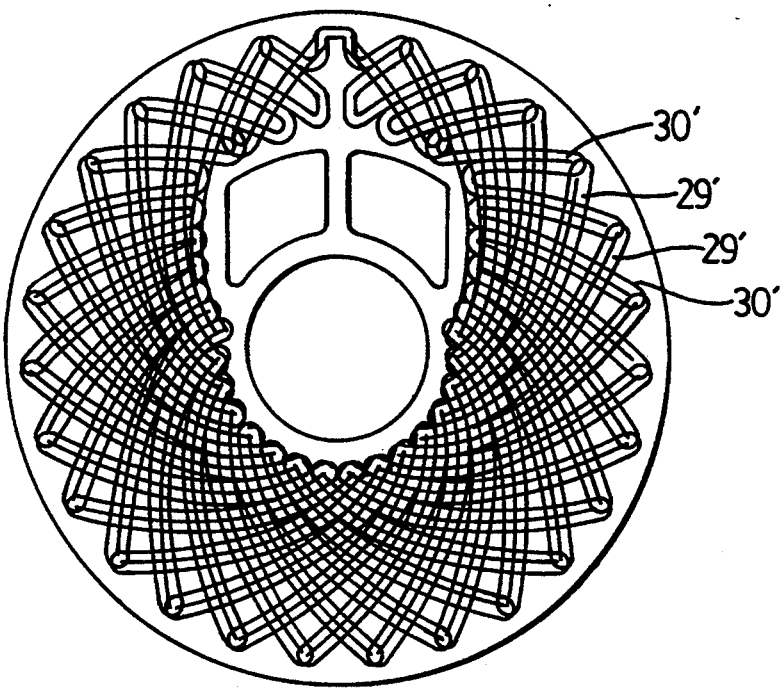
FIG. 7 is a plan view showing the crests and valleys of the upper and lower plates superimposed.

FIG. 7, illustrates the interior surfaces of lower and upper plates 24, 25 with the crests and valleys superimposed to illustrate the circumferential oil flow path. Therein, valleys 29' which correspond to crests 29 in FIG. 3A are arranged to follow spiral curves. Lower plate 25 is, upon assembly, a reverse mirror image of upper plate 24. When upper and lower plates are assembled, facing each other, to form the energy exchange structure of the invention, the valleys following spiral curves of the upper plate cross the valleys following spiral curves of the lower plate.

Figure 8:
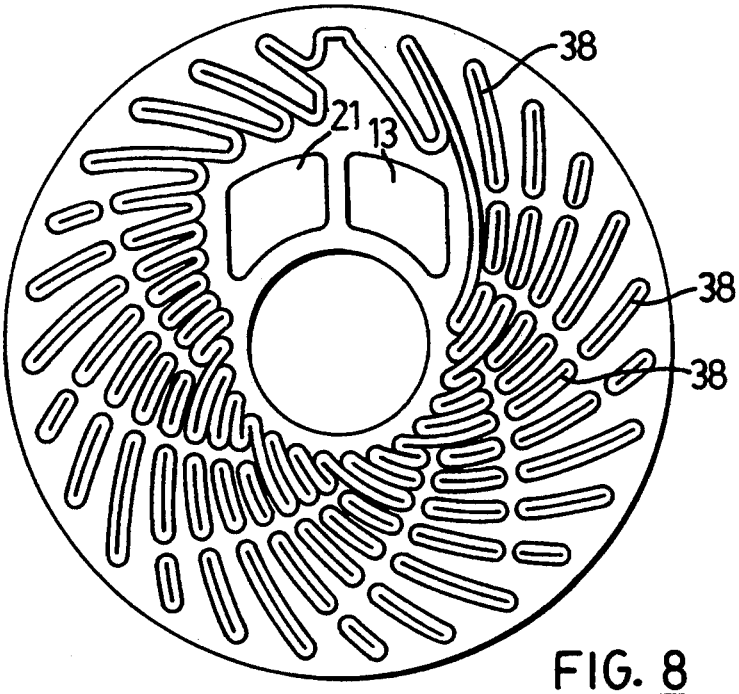
FIG. 8 is a plan view of an embodiment wherein generally straight valleys are arranged generally along spiral curves.

FIG. 8, illustrates an embodiment of the invention wherein generally straight valleys 38 are arranged along a spiral curve in a segmented arrangement.

Typically, the oil coolers of the invention can be manufactured from any convenient material that will withstand the corroding effects and internal fluid pressures of the system. Typical materials include the malleable metals, such as aluminum, copper, steel, stainless steel or alloys thereof and could even include plastics and/or ceramics.

The materials may be internally or externally coated, treated or the like. Typically, it is desirable to use as thin a material as possible to gain maximum efficiency in the energy exchange process. Generally, each of the components of a cooler is desirably formed from the same materials when they are to be joined together. For example, the plates used to manufacture the energy exchange structures would be typically formed from the same material. It should be understood however that it is within the contemplation of the invention to use diverse materials in the assembly, for example the use of steel or plastics in the canisters or surfaces of the ends of the canister while using other metals, plastics or ceramics in the energy exchange structures.

It should be understood that though the illustrated invention comprises an automotive oil cooler, it is seen as being applicable to multiple heat exchanger utilities.

We claim:

1. An improved energy exchange structure, comprising: first and second generally parallel opposing plates joined to define a hollow passageway therebetween and further defining an inlet and an outlet therein and a generally overall circular flow path from the inlet to the outlet, each of said opposing plates undulating in cross-section to define a plurality of opposing valleys forming the hollow passageway, at least some of the valleys of each said plate being arranged to follow spiral curves disposed at an oblique angle to the circular flow path, the oblique angle being higher near the center of the circular flow path than at the outer periphery thereof with apexes of valleys of the first plate arranged to cross apexes of valleys of the second plate such that the area between opposing valleys defines crossing passages.

2. The structure of claim 1 wherein the valleys are formed of generally straight segments arranged along spiral curves.

3. The structure of claim 1 wherein said inlet is positioned adjacent to said outlet, and further comprising a barrier positioned generally centrally in the exchange structure and between the inlet and outlet, so that fluid flows in a circumferential direction between said plates from said inlet to said outlet.

4. The structure of claim 1 wherein the valleys are obliquely disposed at from about 5 to about 75 degrees to the generally overall circular flow path.

5. The structure of claim 1 wherein valleys of a plate are generally equidistantly spaced from adjacent valleys.

6. The structure of claim 1 wherein the valleys are of generally equal width.

7. The structure of claim 1 wherein the plates have peripheral borders joined to form a flat joined border.

8. The structure of claim 7 wherein the peripheral borders of the opposing plates are joined by crimping an edge of one plate over the edge of the other plate.

9. An improved oil cooler, comprising a plurality of stacked energy exchange structures, each said structure comprising:

first and second generally parallel opposing plates joined to define hollow passageway therebetween and further defining an inlet and an outlet therein and a generally overall circular flow path from the inlet to the outlet, each of said opposing plates undulating in cross-section to define a plurality of opposing valleys forming the hollow passageway, at least some of the valleys of each said plate being arranged to follow spiral curves disposed at an oblique angle to the circular flow path, the oblique angle being higher near the center of the circular flow path than at the outer periphery thereof with apexes of valleys of the first plate arranged to cross apexes of valleys of the second plate such that the area between opposing valleys defines crossing passages.

10. The oil cooler of claim 9 wherein inlets of said stacked energy exchange structures are arranged in registration to form an inlet header and outlets of said stacked energy exchange structures are arranged in registration to form an outlet header.

11. The oil cooler of claim 9 wherein an inlet of a first hollow energy exchange structure is connected to an outlet of an adjacent hollow energy exchange structure.

12. The oil cooler of claim 9 wherein the valleys of the energy exchange structures are obliquely disposed at from about 5 to about 75 degrees to the generally overall circular flow path.

13. The cooler of claim 9 wherein the stacked arrangement of hollow energy exchange structures is assembled within a hollow structure configured to allow flow of a second fluid about surfaces of the stacked exchange structures.

* * * * *